United States Patent [19]

Carter

[11] Patent Number: 4,838,195

[45] Date of Patent: Jun. 13, 1989

[54] OPEN BOAT WINDSCREEN

[76] Inventor: Arlen J. Carter, 214 Mechanic St., Franklin, La. 70538

[21] Appl. No.: 40,637

[22] Filed: Apr. 21, 1987

[51] Int. Cl.[4] ..... B63B 17/00

[52] U.S. Cl. ..... 114/343; 114/361

[58] Field of Search ..... 114/201 R, 201 A, 202, 114/203, 343, 361, 364; 296/84 R, 98; 49/324, 349, 372, 404; 135/88, 96; 150/52 K; 160/238

[56] References Cited

U.S. PATENT DOCUMENTS

| | | | |
|---|---|---|---|
| 739,389 | 9/1903 | Castle | 114/361 |
| 1,094,049 | 4/1914 | Barnes | 296/84 |
| 1,481,548 | 1/1924 | Gongaware | 114/361 |
| 2,308,109 | 1/1943 | Rundquist | 114/361 |
| 2,453,422 | 11/1948 | Ellsworth | 114/361 |
| 2,493,833 | 1/1950 | Reynolds | 114/361 |
| 2,513,764 | 7/1950 | Vonder Ahe | 114/361 |
| 2,817,859 | 12/1957 | McCarthy, Jr. | 114/361 |
| 2,864,391 | 12/1958 | Stark | 114/361 |
| 2,974,329 | 3/1961 | Welch | 114/361 |
| 3,604,440 | 9/1971 | Wilson | 114/361 |
| 3,898,947 | 8/1975 | Moore | 114/361 |
| 4,466,374 | 8/1984 | Katz | 114/361 |
| 4,488,750 | 12/1984 | Gerber | 296/78 R |
| 4,641,600 | 2/1987 | Halvorsen | 114/361 |
| 4,671,203 | 6/1987 | Awburg | 114/361 |

*Primary Examiner*—Sherman D. Basinger
*Assistant Examiner*—Stephen P. Avila
*Attorney, Agent, or Firm*—Pravel, Gambrel, Hewitt, Kimball & Krieger

[57] ABSTRACT

An improved windscreen device is provided for use with open hull boats. The device has a pair of spaced apart, elongated spool posts each being angled outwardly and rearwardly with respect to the longitudinal axis of the boat. A fabric-like screen extends between the spool posts and has left and right portions which wrap around the spool posts. A pair of left and right brackets rotatably support the spool posts. A ratchet with a handle may be used for rotating the spool posts so that the slack in the screen may be tightened. The device is affixed to the sides of the hull by brackets which allow the windscreen to be quickly and easily engaged or disengaged from the boat. While in use, it provides adequate protection to the boat's occupants from wind and spray. When not in use, the device can be stored in a compact package.

16 Claims, 2 Drawing Sheets

OPEN BOAT WINDSCREEN

BACKGROUND OF THE INVENTION

The present invention relates to devices for protecting the occupants of open hull boats from wind and spray while the boat is travelling at high speed. The present invention more particularly relates to a low cost, portable easily engaged and disengaged fabric-like windscreen constucted of corrosion-resistant materials.

The use of windshields and screens for the protection of occupants of vehicles including boats is known. Examples of foldable windscreen devices are shown in the following U.S. Pat. Nos. 1,094,049 issued to Barnes, 1,481,548 issued to Gongaware, 2,974,329 issued to Welsh and 4,488,750 issued to Gerber.

Protecting the occupants of open hull boats from the elements has likewise been the quest of many inventors. In addition to windshields and screens which are positioned across the bow of the boat, some of the devices that have been patented encompass a significant portion of the boat. Examples of some of these devices are found in U.S. Pat. Nos. 2,308,109; 739,389 and 3,604,440.

U.S. Pat. No. 2,308,109 issued to C. A. Rundquist is a collapsible wind-spray shield which extends from the bow of the boat rearwardly along the sides of the hull, using a frame and a fabric cover. U.S. Pat. No. 739,389 issued to A. H. Castle is a storm hood and cover which completely encompasses the passenger's section of the boat from its bow through its stern, using a frame with a fabric cover. U.S. Pat. No. 3,604,440 issued to Benjamin L. Wilson is a boat canopy which completely encloses the bow of the boat and the passenger area, using a plurality of bow frames that fit in sockets with a flexible cover.

Additional patents have issued on the concept of an adjustable or collapsible boat frame and cover. U.S. Pat. No. 2,513,764 issued to K. L. Vonder Ahe is a portable folding top which encloses a portion of the passenger area of the boat. U.S. Pat. No. 2,817,859 G. F. McCarthy, Jr. is a wind and spray shield which extends along the sides of the hull and attaches to the gunwale. U.S. Pat. No. 2,453,422 issued to W. D. Ellsworth is a detachable rowboat shelter. U.S. Pat. No. 2,864,391 issued to W. A. Stark is a boat hood. Both the boat hood of Stark and the shelter of Ellsworth are constructed of flexible material which is attached to the gunwale and enclose the bow of the boat.

Some of the devices have transparent windows to afford the occupants a lookout and often the devices are attached to the gunwale or hull of the boat. U.S. Pat. No. 2,308,109 for example issued to Rundquist and U.S. Pat. No. 3,604,440 issued to Wilson are illustrative of this feature.

One of the problems of these prior art devices is that they are complex having many interfitting parts which interact with one another when the device is engaged and disengaged. The large number of interfitting parts are needed to support the flexible fabric, but make for a costly structure difficult to assemble.

Another problem to users of the prior art devices is that some of the devices have many movable joints which can corrode and become immovable when exposed to salt spray. These devices require continuous maintenance.

Some of the patented devices above described are so complicated and have so many working parts that their cost of manufacture is much greater than the price of a small boat, rendering such a cover unusable for small boat owners.

Another problem of the prior art devices relates to the fact that many must be manufactured as part of the original windscreen and cannot be retrofitted to the millions of existing small open boats presently in use.

Yet another problem found in the prior art devices is the fact that frame supports and fabric surround their periphery. In the event of a boating accident where the passengers are thrown about, there is a likelihood of injury from impact with frame supports and windows.

Another problem with some of the patented devices relates to the fact that they require windows in the windshields for visibility which can become discolored and scratched during use; thus, visibility becomes obliterated over a period of time.

Another problem of the prior art devices is that most are installed around the periphery of the bow; thus, providing little or no protection to the operator of the boat who is located in the middle or rear section of the boat.

Yet another problem of some of the prior art windshield devices is that they have straight sides which do not conform to the configuration of the hull, as a result wind wipes around the sides and provides no protection from the elements, when the boat is in operation or even if the sportsmen are stranded.

Another problem experienced with the prior art canopy or hood devices is that they are generally flimsily secured at designated points along the gunwale of the boat. During high winds, the canopy can be torn loose and expose the occupants to the elements.

Yet another problem of some of the prior art devices such as the hoods and canopy is that the support ribs are collapsible and in the event the boat is capsized, the support ribs may collapse, causing the fabric coverings to entrap the occupants.

Yet another problem of some of the prior art devices is that they are cumbersome and do not fold into a size convenient for storage.

Yet another problem of the prior art devices is that they do not have means within which the boat's occupants can store sporting goods and personal items.

SUMMARY OF THE PRESENT INVENTION

The present invention solves these prior art problems and shortcomings by providing a windscreen device that is sturdy, low cost and simple to engage or disengage and which can be easily retrofitted to any small open boat. It can be constructed of corrosion resistant materials which do not easily deteriorate when exposed to salt spray. Support brackets and spool posts are located on the left and right sides of the hull so that in the event of a boating accident where the passengers are thrown forward, there is a substantial likelihood that the passengers will make contact solely with a fabric-like screen and not the support structures. Further, the present invention may be attached to the sides of the hull at the bow, at its midsection, or near the stern at the discretion of the operator in order to afford the operator and passengers optimum protection from the elements, and depending on the location of the operator and passengers in any particular open boat.

The fact that the present invention is attached to the hull near the bottom of the boat and extends upwardly provides several distinct advantages which include reducing the likelihood that the fabric-like screen will be torn in high winds, and providing a shelter in the event the occupants of the boat are stranded.

The fact that the device does not require windows for visibility also provides several distinct advantages. First, there are no windows to be scratched or discolored over time. Second, there are no windows to injure the passengers in the event of a boating accident. Third, the operator has greater visibility by looking over the fabric-like screen.

There are several advantages to the present invention not having a hood or canopy supported by a complex frame of internal ribs. First, there are less moving parts that are susceptible to corrosion. Second, there is less likelihood of collapse during high winds. Third, there is less likelihood of the occupants becoming entrapped in the device in the event the boat capsizes. Additionally, the long assembly time frequently associated with many frame and fabric-type shelter having numerous interfitting frame parts is eliminated.

The present invention can provide additional storage space by the inclusion of pouches and retaining means such as straps on the fabric-like screen.

The present invention thus provides a very simply, easy to manufacture, yet very workable solution to the problems inherent in many of the prior art patents.

The present invention thus provides an open hull windscreen device that includes a support plate which is attached to the side of the hull, left and right brackets having lower and upper portions into which are inserted spool posts. A fabric-like screen spans the distance between the left and right spool posts. The tension of the fabric-like screen is regulated by a ratchet mechanism which is affixed to the brackets.

GENERAL DISCUSSION OF THE PRESENT INVENTION

The preferred embodiment of the apparatus of the present invention provides an easily installed windscreen for open hull boats. It is a device comprising generally of a pair of left and right support brackets into which are inserted elongated spool posts. A fabric-like screen extends between and wraps around the spool posts. A ratchet affixed to preferably each bracket allows the spool posts to rotate within the brackets to tighten the slack in the screen. When the windscreen device is installed in an open boat, it is angled outwardly and rearwardly with respect to the longitudinal axis of the boat in order to afford the occupants optimum protection from the elements without completely enclosing the hull.

The windscreen device is installed in the boat by first affixing a support plate to the side of the hull between the gunwale and the bottom of the hull. The support plate is attached to the hull by fastening means such as screws, bolts or rivets. The support plate adds stability to the windscreen device and reinforces the area of its attachment to the hull. Such reinforcement can be needed since many open hull boats are often constructed of durable yet lightweight materials.

Each bracket is composed of preferably three primary components: a lower bracket, a bracket support bar and an upper bracket. The lower bracket is attached to the support plate by fastening means such as nut and bolt assemblies or screws. The lower bracket comprises a channel member and a perpendicular cross bar. The channel member is directly attached to the support plate. The channel member has at its end closest to the bottom of the hull a cross bar which is angled perpendicular to the channel member. The end of the channel member opposing the cross bar receives the bracket support bar. An easily removable fastening means such as a pin or nut and bolt assembly is inserted into a bore (not shown) which passes through the channel member and the bracket support bar in order to hold the upper bracket in place.

The upper bracket, like the lower bracket, is composed of a longitudinally extending channel member and a perpendicular cross bar. The bracket support bar which spans the distance between the upper and lower brackets is inserted into the channel member of the upper support bracket. Fastening means such as a wing nut and bolt assembly secure the upper bracket to the bracket support bar. Elongated spool posts are inserted into the cross bar of the upper and lower brackets and extend at an angle essentially parallel to the channel members of the upper and lower brackets and the bracket support bar. Once the spool posts are inserted in the cross bars, a tension screw which extends across the channel member is tightened in order to retain the cross bar in at an angle substantially perpendicular to the channel member.

A ratchet affixed to the upper support brackets cause the spool posts to rotate. The ratchet means comprises for example a dog gear, a spring loaded stop, and a handle for turning the spool post. A washer and a spring pin affixed to the lower surface of the cross bar allow the dog gear sufficient play to rotate.

A fabric-like screen consisting for example of canvas or heavy-duty plastic extends between and wraps around the spool posts. Grommets placed along the left and right sides of the screen receive screws that are inserted into bores in the spool posts in order to attach the screens to the spool posts. The fabric-like screen can provide storage space by the addition of pouches or retaining straps along its surface.

The upper and lower brackets, bracket support bar, ratchet and spool posts can be made of lightweight, but structural, corrosion-resistant materials such as aluminum or stainless steel. In the preferred embodiment of the present invention, the aluminum can for example be cast so that the channel members and the cross bar of the brackets are of unitary construction.

An object of the present invention is to provide a new and improved windscreen device which provides protection from wind and water spray to the occupants of open hull boats.

A further object of the present invention is to provide a new and improved windscreen device which provides greater stability during use.

A further object of the present invention is to provide a windscreen device that can easily be retrofitted to various sizes of common smaller open hull boats.

A further object of the present invention is to provide a windscreen device that is easily and quickly engaged and disengaged from the hull of a boat.

A further object of the present invention is to provide a windscreen device of compact design that can be conveniently stored when not in use.

A further object of the present invention is to provide a windscreen device that is of lightweight, flexible material which reduces the likelihood of injury to occupants should they be thrown forward during a boating accident.

A further object of the present invention is to provide a low cost windscreen device.

A further object of the present invention is to provide a windscreen device with brackets that are movable to allow the fabric-like screen to be placed at the angle desired by the operator.

A further object of the present invention is to provide a windscreen device constructed of corrosion resistant materials.

A further object of the present invention is to provide a windscreen device that conforms to the shape of the hull and can be selectively positioned at the bow, mid-section or stern as desired in order to afford the boat's operator and passengers optimum protection from the elements in any particular open boat seating arrangement.

A further object of the present invention is to provide a windscreen device that has storage means such as, for example, pouches and retaining straps for receiving sporting goods and personal items.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
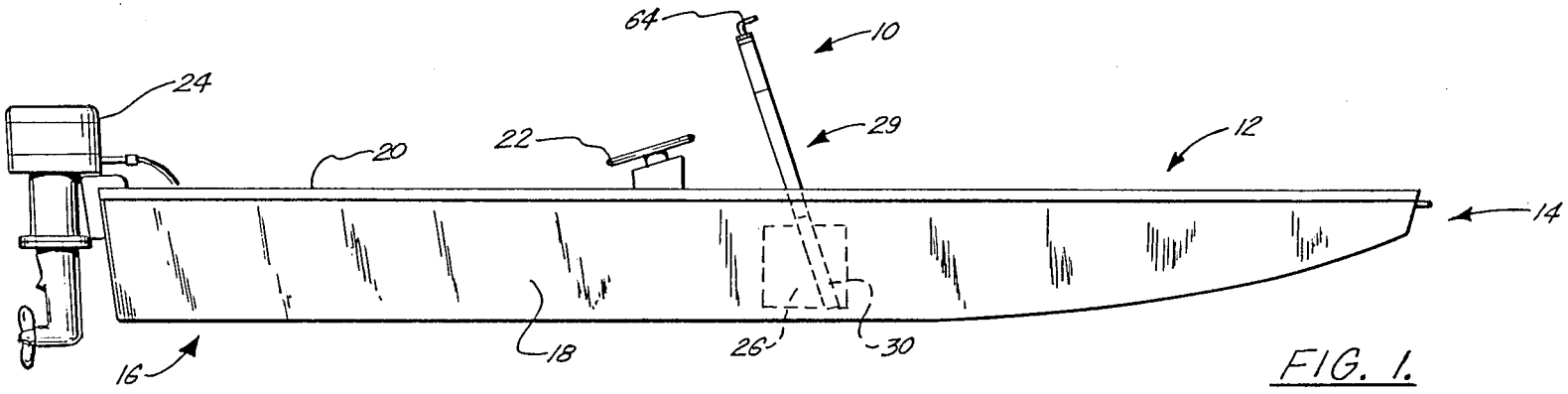
FIG. 1 is a right side view of an open hull boat having the windscreen in place showing in broken line the support plate and lower support bracket.
Figure 2:
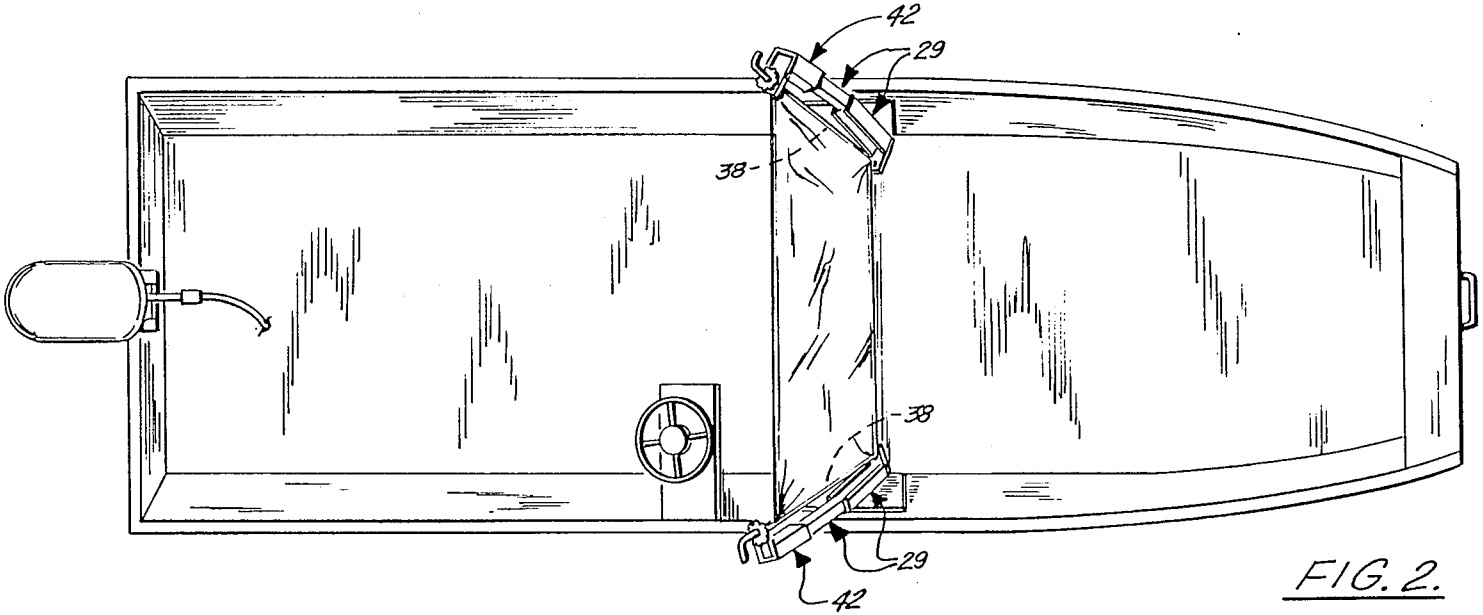
FIG. 2 is a top perspective view of an open hull boat showing the windscreen installed.
Figure 3:
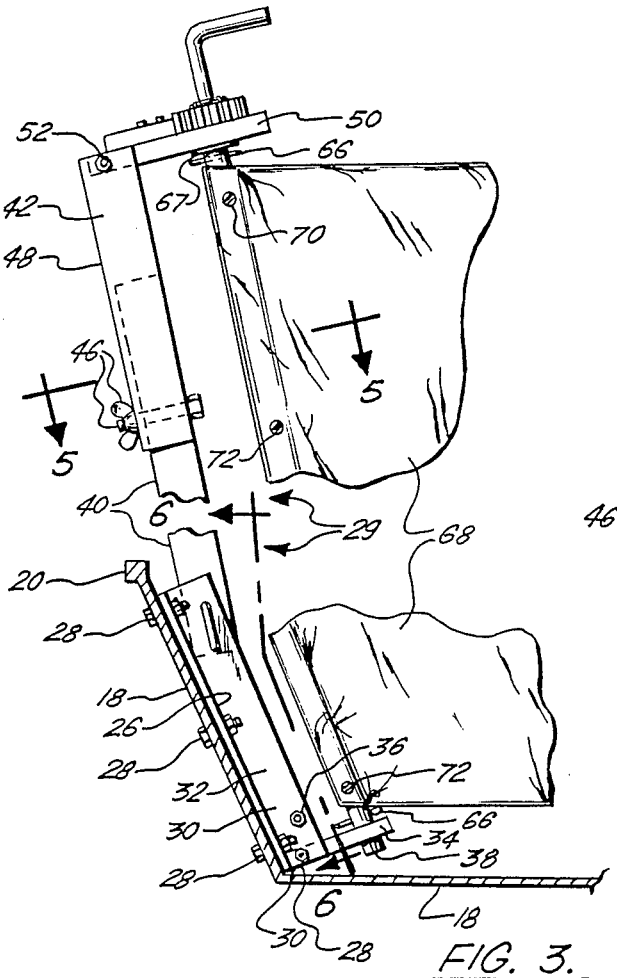
FIG. 3 is a rear fragmentary view of a portion of the wind screen spool post and bracket mounted on the side of the hull of the boat.

FIGS. 1, 2 and 3 illustrate best the preferred embodiment of the apparatus of the present invention, generally designated as numeral 10. Windscreen device 10 is designed to be installed in boat 12 comprising bow 14, stern 16, hull 18, gunwale 20, steering wheel 22 and motor 24. Boat 12 can have seats for example for operator and passengers, not shown in the drawings.

Figure 6:
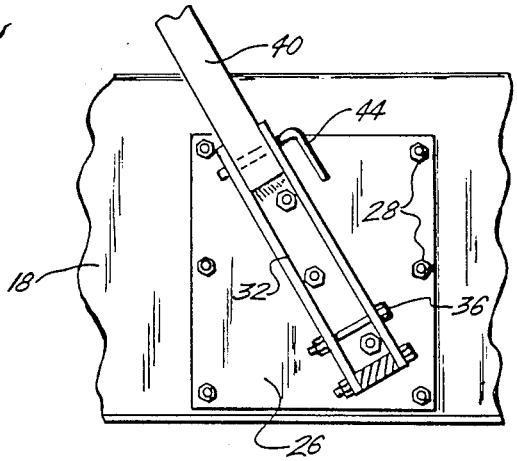
FIG. 6 is a front elevation view taken along line 6—6 of FIG. 3 of the lower bracket and bracket support bar mounted to the support plate which is affixed to the side of the hull between the gunwale and the bottom of the hull.
Figure 7:
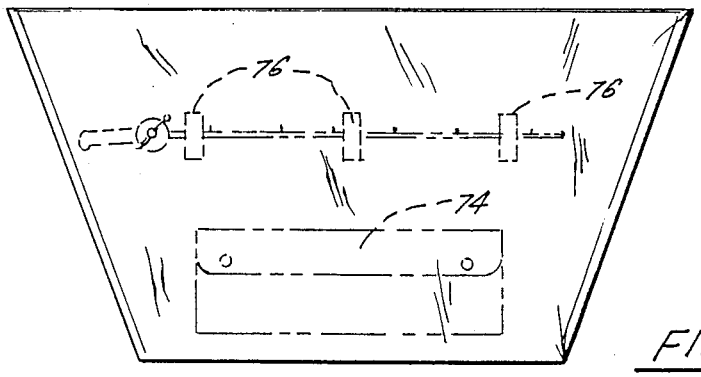
FIG. 7 is a front view of the fabric-like screen storage pouch and straps which can accommodate fishing poles, rifles and other sporting goods.

Hull 18 is often made of lightweight durable material. To secure windscreen device 10, a pair of support plates 26 are mounted on the right and left sides of hull 18. Each support plate 26 is positioned between gunwale 20 and the bottom of hull 18 forward of the boat operator. Fasteners 28 such as bolts, rivets or screws are used to mount support plate 26 to hull 18. See for example FIG. 6. Support plates 26 provide stability for windscreen device 10.

FIGS. 2 and 3 illustrate best the pair of left and right brackets 29. Each bracket 29 has a lower bracket 30 which is attached to each support plate 26. Lower bracket 30 comprises channel member 32 and cross bar 34. Cross bar 34 is attached to channel member 32 by fasteners 28. Cross bar 34 has a bore (not shown) to receive spool post 38. Tension screw 36 extends across channel member 32. Once spool post 38 is positioned in the bore (not shown) of cross bar 34, tension screw 36 is tightened to retain cross bar 34 in a position substantially perpendicular to channel member 32.

Bracket support bar 40 spans the distance between lower bracket 30 and upper bracket 42. Bracket support bar 40 is inserted into lower bracket 30 and upper bracket 42. Bracket support bar 40 is connected to lower bracket 30 by removable fasteners such as a pin 44. Bracket support bar 40 is connected to upper bracket 42 by removable fasteners such as a bolt and wing nut assembly 46.

Each bracket 29 has a pair of left and right upper brackets 42 comprising channel member 48 and cross bar 50. Cross bar 50 is affixed to channel member 48 by fastener 52 such as a bolt and nut assembly.

Figure 4:
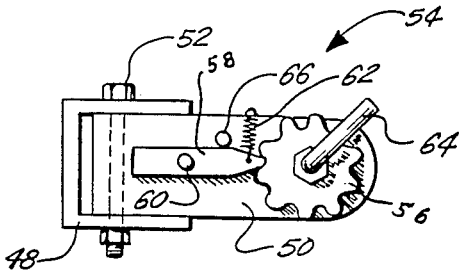
FIG. 4 is a top perspective view of the ratchet used to tighten the slack in the fabric-like windscreen.
Figure 5:
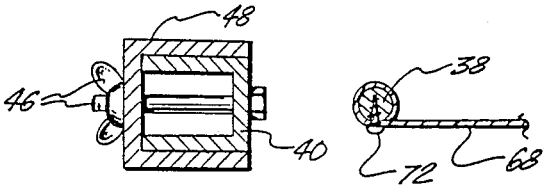
FIG. 5 is a fragmentary sectional view of bracket support bar, the channel member of the upper bracket, the spool post and the windscreen material, the plane of the section being indicated by the line 5—5, in FIG. 3.

Ratchet 54 is affixed adjacent to the upper surface of cross bar 50. Ratchet 54 comprises dog-toothed gear 56, stop 58, spring 62, handle 64, spring pins 66 and washer 67. Stop 58 is affixed to cross bar 50 by fastener 60. See FIG. 4.

Fabric-like screen 68 which is composed of materials such as canvas or heavy duty plastic extends between and wraps around a pair of left and right spool posts 38 which are inserted into lower bracket 30 and upper bracket 42. Grommets 70 spaced apart from one another along the left and right periphery of fabric-like screen 68 receive screws 72 which are inserted into bores (not shown) along the length of spool posts 38.

Fabric-like screen 68 can support a plurality of storage pouches shown in phantom line and designated as number 74 which can be sized to accommodate personal effects and sporting goods such as hats, gloves, cameras, first aid kit, reels, shotgun shells and the like. Fabric-like screen 68 can also support retaining means such as straps shown in phantom line and designated as number 76 which can accommodate fishing poles, rifles and other sporting goods.

What is claimed as the invention is:

1. An open boat windscreen apparatus, comprising:

(a) a pair of spaced-apart, elongated spool posts, each being angled outwardly and rearwardly with respect to the longitudinal axis of the boat;

(b) a flexible fabric-like screen extending between the spool posts and having left and right side portions for wrapping upon the spool posts respectively;

(c) a pair of left and right brackets for rotatably supporting the spool posts;

(d) ratchet means for tightening at least one spool post in at least one rotational direction;

(e) handle means on the upper portion of at least one spool post for rotating the spool post;

(f) connection means for removably mounting the spool posts upon the left and right brackets so that the spool posts and fabric-like screen can be quickly removed from the boat; and (g) left and right brackets each having an upper and lower bracket and a racket support bar which spans the distance between the lower and upper brackets.

2. An open boat windscreen apparatus, comprising:

(a) a pair of spaced-apart, elongated spool posts, each being angled outwardly and rearwardly with respect to the longitudinal axis of the boat;

(b) a flexible fabric-like screen extending between the spool posts and having left and right side portions for wrapping upon the spool posts respectively;
(c) a pair of left and right brackets for rotatably supporting the spool posts;
(d) ratchet means for tightening at least one spool post in at least one rotatonal direction;
(e) handle means on the upper portion of at least one spool post for rotating the spool post;
(f) oonnection means for removably mounting the spool posts upon the left and right brackets so that the spool posts and fabric-like screen can be quickly removed from the boat; and
(g) a support plate which is attached to the hull of the boat.

3. The apparatus of claim 2, wherein the fabric-like screen has retaining means such as straps for affixing a gun or fishing pole thereto.

4. The windscreen apparatus of claim 2 wherein the fabric-like screen has at least one storage pouch.

5. An open boat windscreen apparatus, comprising:
(a) a pair of spaced-apart, elongated spool posts;
(b) a flexible, fabric-like screen extending between the spool posts and having left and right side portions for wrapping around the spool posts respectively;
(c) a pair of left and right brackets for rotatably supporting the spool posts;
(d) ratchet means for tightening at least one spool post in at least one rotational direction;
(e) handle means on the upper portion of at least one spool post for rotating the spool post; and
(f) connection means for removably mounting the spool posts upon the bracket means so that the spool posts and fabric-like screen can be quickly removed from the boat, wherein the spool posts, fabric-like screen, left and right brackets, ratchet means, handle and connection means are constructed of corrosion-resistant material.

6. The apparatus of claim 5, further comprising a support plate which is attached to the hull of the boat.

7. The apparatus of claim 5, wherein the fabric-like screen has retaining means such as straps for affixing a gun or fishing pole thereto.

8. An open boat windscreen apparatus, comprising:
(a) a pair of spaced-apart, elongated spool posts;
(b) a flexible, fabric-like screen extending between the spool posts and having left and right side portions for wrapping around the spool posts respectively;
(c) a pair of left and right brackets for rotatably supporting the spool posts;
(d) ratchet means for tightening at least one spool post in at least one rotatonal direction;
(e) handle means on the upper portion of at least one spool post for rotating the spool post; and
(f) connection means for removably mounting the spool posts upon the bracket means so that the spool posts and fabric-like screen can be quickly removed from the boat, wherein the fabric-like screen has retaining means such as straps for affixing a gun or fishing pole thereto.

9. The apparatus of claim 8, further comprising a support plate which is attached to the hull of the boat.

10. An open boat windscreen apparatus, comprising:
(a) first and second spaced-apart, upstanding spool posts;
(b) a flexible fabric-like screen extending between the spool posts;
(c) support means for rotatably supporting the first spool post and for supporting the second spool post;
(d) ratchet means for tightening the screen between the spool posts by rotating the first spool post in at least one rotatonal direction; and
(e) means for attaching the apparatus to a boat, wherein each post is angled outwardly and rearwardly with respect to the longitudinal axis of the boat.

11. The apparatus of claim 10, further comprising a support plate which is attached to the hull of the boat.

12. The apparatus of claim 10, further comprising handle means on the upper portion of the first spool post for rotating the first spool post.

13. The apparatus of claim 10, further comprising connection means for removably mounting the spool posts upon the support means so that the spool posts and fabric-like screen can be quickly removed from the boat.

14. The apparatus of claim 10, wherein the spool posts, fabric-like screen, support means, and ratchet means are constructed of corrosion-resistant material.

15. The windscreen apparatus of claim 10, wherein the fabric-like screen has at least one storage pouch.

16. The apparatus of claim 10, wherein the fabric-like screen has retaining means such as straps for affixing a gun or fishing pole thereto.

* * * * *